US006298503B1

(12) United States Patent
Hsu

(10) Patent No.: US 6,298,503 B1
(45) Date of Patent: Oct. 9, 2001

(54) BED ASSEMBLY HAVING A SHELTER

(76) Inventor: Ching-Lung Hsu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/471,733

(22) Filed: Dec. 23, 1999

(51) Int. Cl.[7] ..... A47C 19/22; A47C 29/00
(52) U.S. Cl. ..... 5/2.1; 5/414; 52/167.1
(58) Field of Search ..... 5/414, 2.1; 52/167.1, 52/167.3

(56) References Cited

U.S. PATENT DOCUMENTS 4,782,541 * 11/1988 Tuchman ..... 5/414
5,615,424 * 4/1997 Nakata ..... 5/2.1
6,101,769 * 8/2000 Hamill ..... 52/167.1

FOREIGN PATENT DOCUMENTS

402096059A * 4/1990 (JP) ..... 5/414

* cited by examiner

*Primary Examiner*—Alexander Grosz

(57) ABSTRACT

A bed assembly has a shelter, a hollow casing enclosing the shelter, and a cushion panel disposed on the hollow casing. The hollow casing has an opening, a plurality of periphery holes, a large number of vent holes, and four hollow positioning seats receiving four threaded rods. Four reinforced panels are fastened on four sides of the hollow casing. The shelter has two transverse steel plates and four longitudinal steel plates. A headboard is disposed on a front portion of the hollow casing. A first cabinet is disposed on a first lateral of the hollow casing. A second cabinet is disposed on a second lateral of the hollow casing.

8 Claims, 6 Drawing Sheets

BED ASSEMBLY HAVING A SHELTER

BACKGROUND OF THE INVENTION

The present invention relates to a bed assembly. More particularly, the present invention relates to a bed assembly which has a shelter.

A conventional bed does not have a shelter. When an earthquake occurs, people cannot hide in the shelter. Therefore, a furniture may fall down to hurt people in a bedroom while a large earthquake occurs.

SUMMARY OF THE INVENTION

An object of the present invention is to provide a bed assembly which has a shelter to protect people while a large earthquake occurs.

Accordingly, a bed assembly comprises a shelter, a hollow casing enclosing the shelter, and a cushion panel disposed on the hollow casing. The hollow casing has an opening, a plurality of periphery holes, a large number of vent holes, and four hollow positioning seats receiving four threaded rods. Four reinforced panels are fastened on four sides of the hollow casing. Each of the reinforced panels has a large number of vent apertures. The shelter has two transverse steel plates and four longitudinal steel plates. Each of the transverse steel plates has a plurality of reinforced bars, a plurality of threaded holes, and a plurality of round holes receiving a plurality of threaded posts. Each of the longitudinal steel plates has a plurality of round apertures, a plurality of reinforced ribs, and a large number of through holes.

In accordance with a first preferred embodiment of the present invention, a bed assembly comprises a shelter, a hollow casing enclosing the shelter, and a cushion panel disposed on the hollow casing. The hollow casing has an opening, a plurality of periphery holes, a large number of vent holes, and four hollow positioning seats receiving four threaded rods. Four reinforced panels are fastened on four sides of the hollow casing by a plurality of screws. The screws pass through the vent holes of the hollow casing. Each of the reinforced panels has a large number of vent apertures. The shelter has two transverse steel plates and four longitudinal steel plates. Each of the transverse steel plates has a plurality of reinforced bars, a plurality of threaded holes, and a plurality of round holes receiving a plurality of threaded posts. Each of the longitudinal steel plates has a plurality of round apertures, a plurality of reinforced ribs, and a large number of through holes. A headboard is disposed on a front portion of the hollow casing. Two protection bars are disposed on two of the reinforced panels. Two foamed plastics plates are disposed in the shelter. Four nuts are disposed on a bottom of the shelter to engage with the threaded posts. One of the longitudinal steel plates has a slot receiving a folding door. The folding door has a magnet and a handle. A first cabinet is disposed on a first lateral of the hollow casing. A second cabinet is disposed on a second lateral of the hollow casing. An emergency electric power source is disposed in the shelter. The emergency electric power source comprises a socket, a lamp, and a horn.

In accordance with a second preferred embodiment of the present invention, a bed assembly comprises two shelters, a hollow casing enclosing the shelters, and a cushion panel disposed on the hollow casing. A channel is formed between the shelters and communicated with the shelters. The hollow casing has an opening. A headboard is disposed on a front portion of the hollow casing. A plurality of foamed plastics plates are disposed in the shelters. Each longitudinal steel plate has a slot receiving a folding door. Each longitudinal steel plate is adjacent to the respective foamed plastics plate. A first cabinet is disposed on a first lateral of the hollow casing. A second cabinet is disposed on a second lateral of the hollow casing.

DETAILED DESCRIPTION OF THE INVENTION

Figure 1:
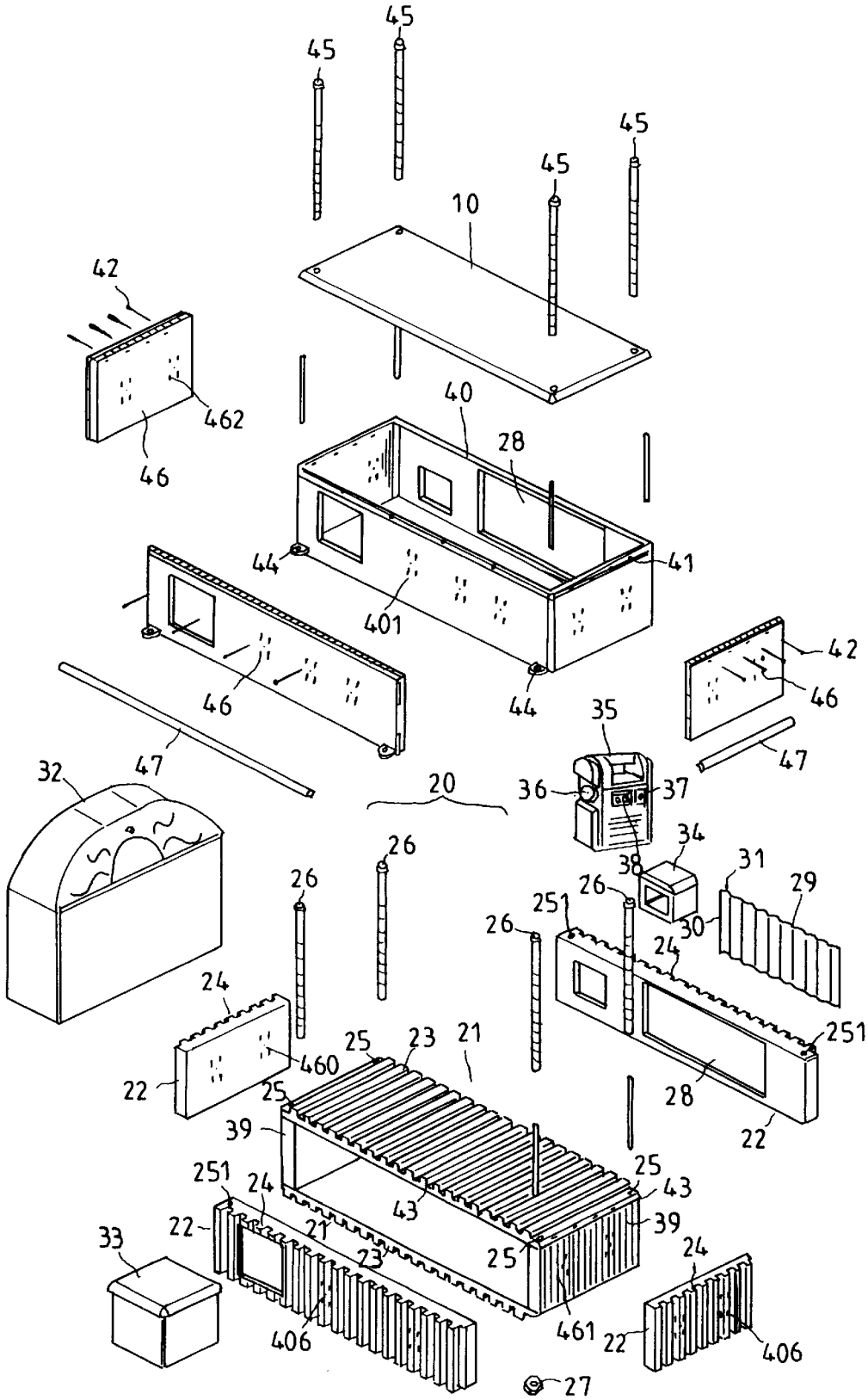
FIG. 1 is a perspective exploded view of a bed assembly of a preferred embodiment in accordance with the present invention.
Figure 2:
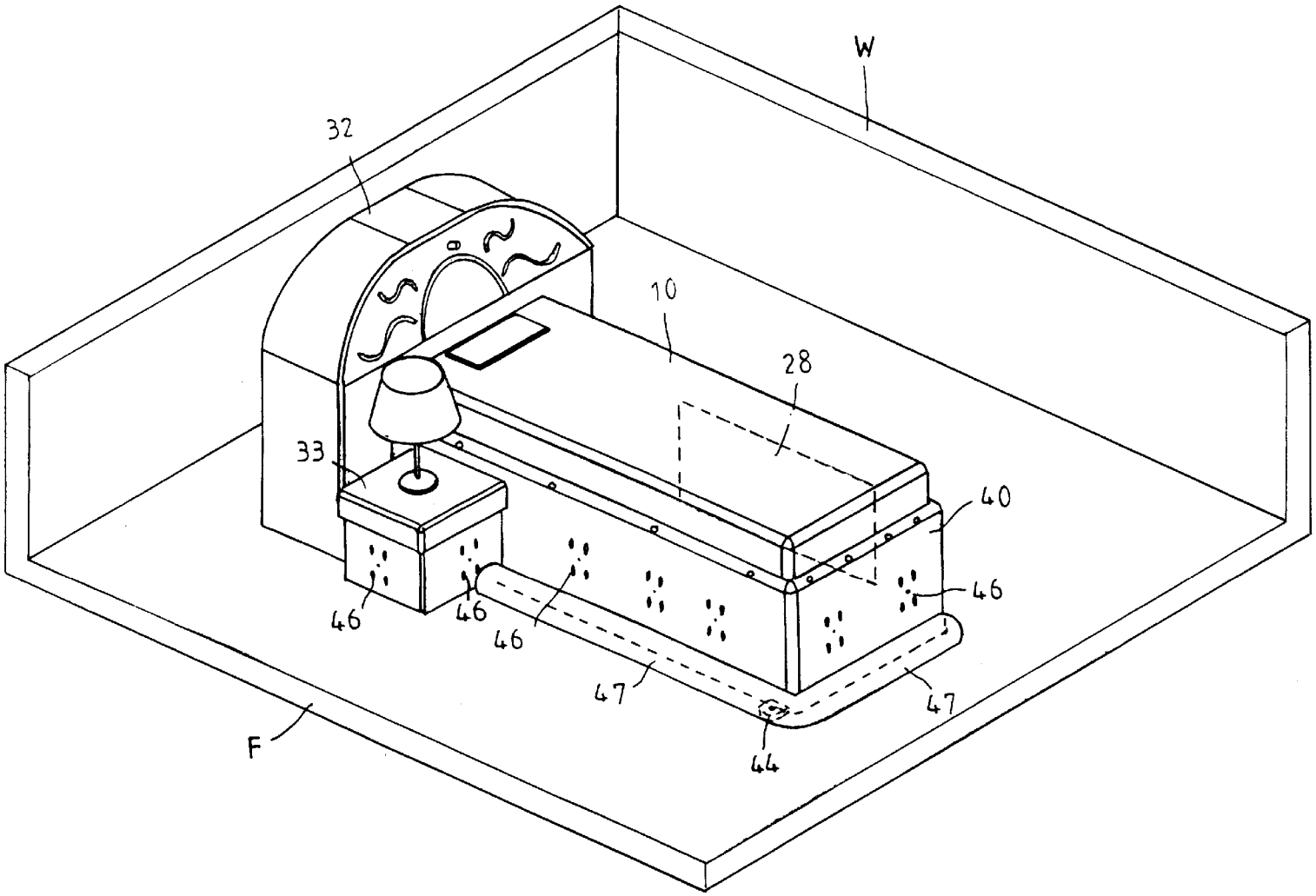
FIG. 2 is a perspective assembly view of a bed assembly of a preferred embodiment disposed in a bedroom.
Figure 3:
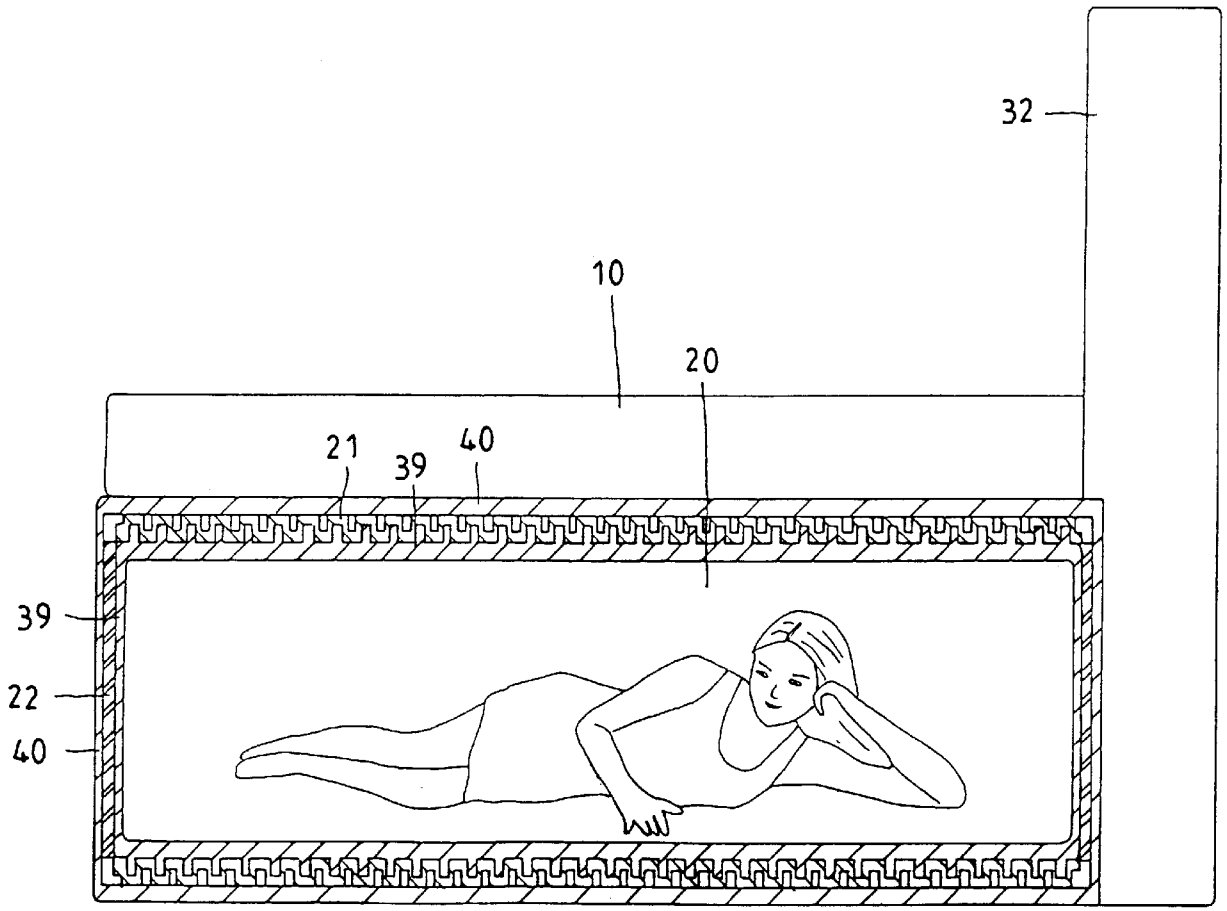
FIG. 3 is a schematic view illustrating a user protected by a shelter of a preferred embodiment in accordance with the present invention.

Referring to FIGS. 1 to 3, a bed assembly comprises a shelter 20, a hollow casing 40 enclosing the shelter 20, and a cushion panel 10 disposed on the hollow casing 40.

The hollow casing 40 has an opening 28, a plurality of periphery holes 41, a large number of vent holes 401, and four hollow positioning seats 44 receiving four threaded rods 45.

Four reinforced panels 46 are fastened on four sides of the hollow casing 40 by a plurality of screws 42. The screws 42 pass through the periphery holes 41 of the hollow casing 40. Each of the reinforced panels 46 has a large number of vent apertures 462.

The shelter 20 has two transverse steel plates 21 and four longitudinal steel plates 22.

Each of the transverse steel plates 21 has a plurality of reinforced bars 23, a plurality of threaded holes 43 receiving the screws 42, and a plurality of round holes 25 receiving a plurality of threaded posts 26.

Each of the longitudinal steel plates 22 has a plurality of round apertures 251, a plurality of reinforced ribs 24, and a large number of through holes 460.

A headboard 32 is disposed on a front portion of the hollow casing 40.

Two protection bars 47 are disposed on two of the reinforced panels 46.

Two foamed plastics plates 39 are disposed in the shelter 20 in order to protect the user.

Four nuts 27 are disposed on a bottom of the shelter 20 to engage with the threaded posts 26.

One of the longitudinal steel plates 22 has a slot 28 receiving a folding door 29. The folding door 29 has a magnet 30 and a handle 31.

A first cabinet 33 is disposed on a first lateral of the hollow casing 40. A second cabinet 34 is disposed on a second lateral of the hollow casing 40.

An emergency electric power source 35 is disposed in the shelter 20. The emergency electric power source 35 comprises a socket 38, a lamp 36, and a horn 37.

Referring to FIGS. 1 and 2 again, four threaded rods 45 fasten the hollow casing 40 on a floorboard F. When an earthquake occurs, the user can open the folding door 29 to enter the shelter 20. The folding door 29 should face a wall W.

Figure 4:
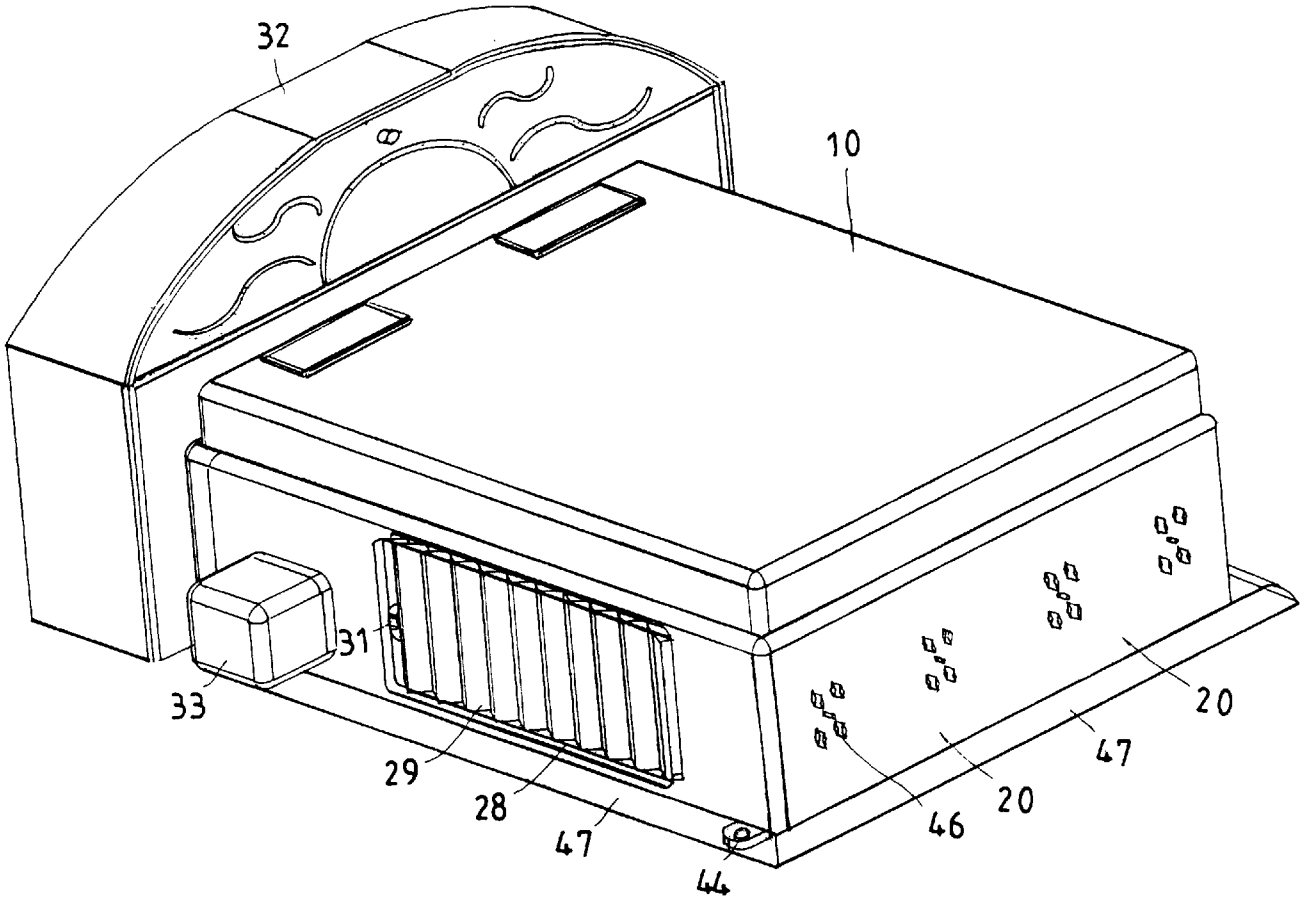
FIG. 4 is a perspective assembly view of a bed assembly of another preferred embodiment in accordance with the present invention.
Figure 5:
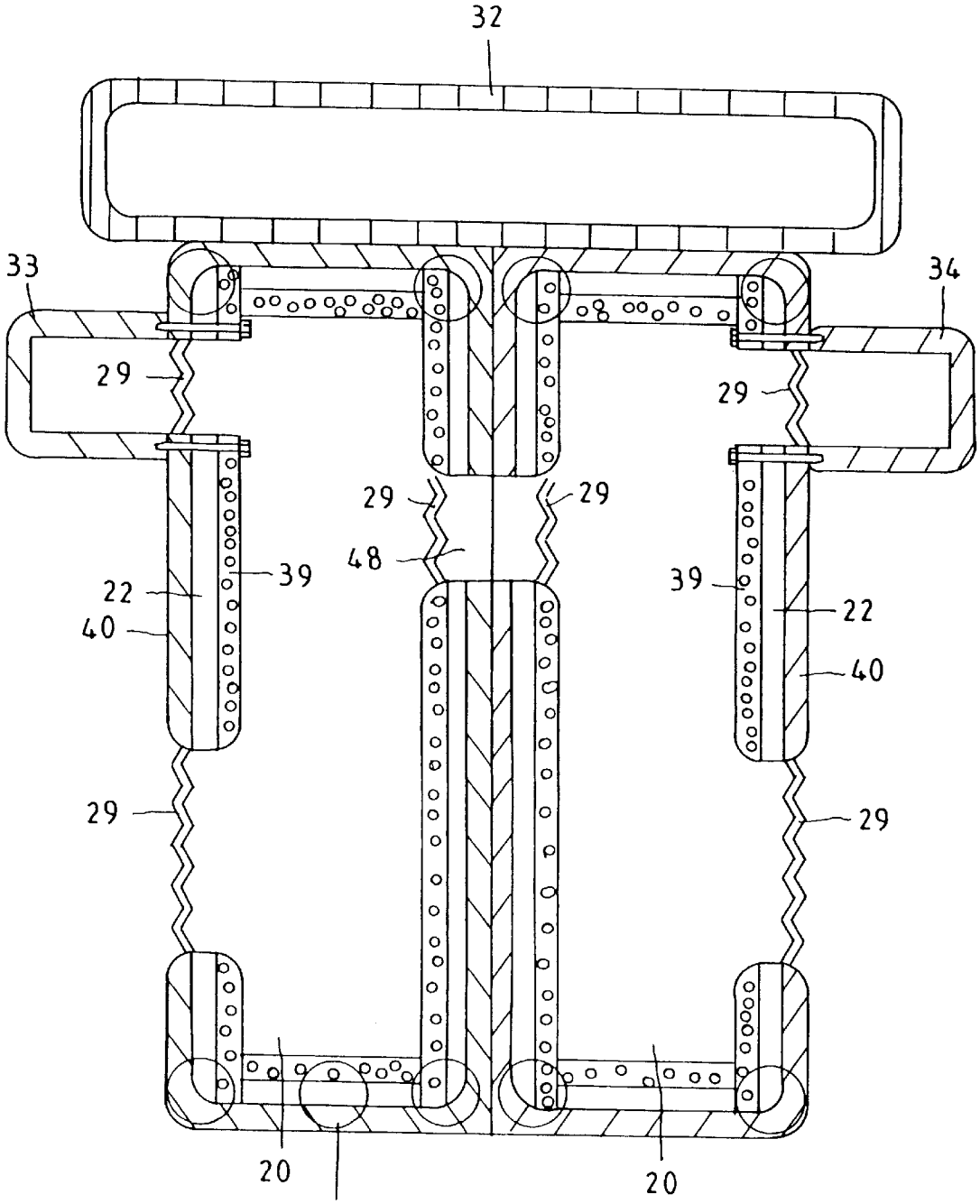
FIG. 5 is a sectional assembly view of a bed assembly of another preferred embodiment in accordance with the present invention.
Figure 5A:
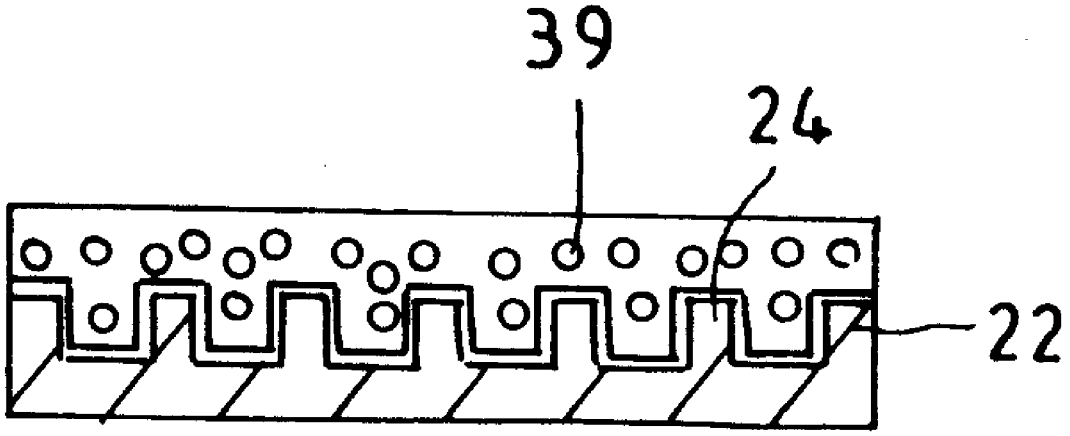
FIG. 5A is a sectional assembly view of a foamed plastics panel and a longitudinal steel plate.

Referring to FIGS. 4, 5, and 5A, another bed assembly comprises two shelters 20, a hollow casing 40 enclosing the shelters 20, and a cushion panel 10 disposed on the hollow casing 40. A channel 48 is formed between the shelters 20 and communicated with the shelters 20. The hollow casing 40 has an opening 28.

A headboard 32 is disposed on a front portion of the hollow casing 40.

A plurality of foamed plastics plates 39 are disposed in the shelters 20 in order to protect the user.

Each longitudinal steel plate 22 has a slot 28 receiving a folding door 29. Each longitudinal steel plate 22 is adjacent to the respective foamed plastics plate 39.

A first cabinet 33 is disposed on a first lateral of the hollow casing 40. A second cabinet 34 is disposed on a second lateral of the hollow casing 40.

The users can enter two shelters 20 easily and can communicate with each other via the channel 48.

The present invention is not limited to the above embodiments but various modification thereof may be made. Furthermore, various changes in form and detail may be made without departing from the scope of the present invention.

I claim:

1. A bed assembly comprises:

a shelter, a hollow casing enclosing the shelter, and a cushion panel disposed on the hollow casing, the hollow casing having an opening, a plurality of periphery holes, a large number of vent holes, and four hollow positioning seats receiving four threaded rods, four reinforced panels fastened on four sides of the hollow casing by a plurality of screws, each of the reinforced panels having a large number of vent apertures, the shelter having two transverse steel plates and four longitudinal steel plates, each of the transverse steel plates having a plurality of reinforced bars, a plurality of threaded holes receiving the screws, and a plurality of round holes receiving a plurality of threaded posts, and each of the longitudinal steel plates having a plurality of round apertures, a plurality of reinforced ribs, and a large number of through holes.

2. The bed assembly as claimed in claim 1, wherein a headboard is disposed on a front portion of the hollow casing.

3. The bed assembly as claimed in claim 1, wherein two protection bars are disposed on two of the reinforced panels.

4. The bed assembly as claimed in claim 1, wherein two foamed plastics plates are disposed in the shelter.

5. The bed assembly as claimed in claim 1, wherein one of the longitudinal steel plates has a slot receiving a folding door.

6. The bed assembly as claimed in claim 1, wherein an additional shelter is disposed in the hollow casing.

7. The bed assembly as claimed in claim 1, wherein a first cabinet is disposed on a first lateral of the hollow casing and a second cabinet is disposed on a second lateral of the hollow casing.

8. The bed assembly as claimed in claim 1, wherein an emergency electric power source is disposed in the shelter.

* * * * *